United States Patent [19]

Poynor et al.

[11] 4,430,197

[45] Feb. 7, 1984

[54] HYDROGEN DONOR CRACKING WITH DONOR SOAKING OF PITCH

[75] Inventors: Paul C. Poynor; Hugh E. Romine, both of Ponca City, Okla.

[73] Assignee: Conoco Inc., Ponca City, Okla.

[21] Appl. No.: 365,721

[22] Filed: Apr. 5, 1982

[51] Int. Cl.[3] ..... C10G 9/14; C10G 57/00

[52] U.S. Cl. ..... 208/56; 208/67; 208/131; 208/132

[58] Field of Search ..... 208/131, 56, 67

[56] References Cited

U.S. PATENT DOCUMENTS

| | | | |
|---|---|---|---|
| 2,873,245 | 2/1959 | Thompson et al. . | |
| 3,238,118 | 3/1966 | Arey, Jr. et al. . | |
| 3,817,853 | 6/1974 | Folkins | 208/80 |
| 4,090,947 | 5/1978 | Satchell, Jr. | 208/50 |
| 4,101,416 | 7/1978 | Dolbear . | |
| 4,115,246 | 9/1978 | Sweeny | 208/56 |
| 4,178,229 | 12/1979 | McConaghy et al. | 208/50 |
| 4,213,846 | 7/1980 | Sootu et al. | 208/131 |
| 4,363,716 | 12/1982 | Greene et al. | 208/56 |

FOREIGN PATENT DOCUMENTS

| | | | |
|---|---|---|---|
| 553169 | 2/1958 | Canada | 208/56 |
| 786451 | 11/1957 | United Kingdom | 208/56 |

*Primary Examiner*—Delbert E. Gantz
*Assistant Examiner*—Helane E. Maull
*Attorney, Agent, or Firm*—Richard W. Collins

[57] ABSTRACT

A hydrogen donor diluent cracking process in which the pitch fraction from the cracking step is heat soaked in the presence of hydrogen donor solvent and then returned to the cracking coil.

6 Claims, 1 Drawing Figure

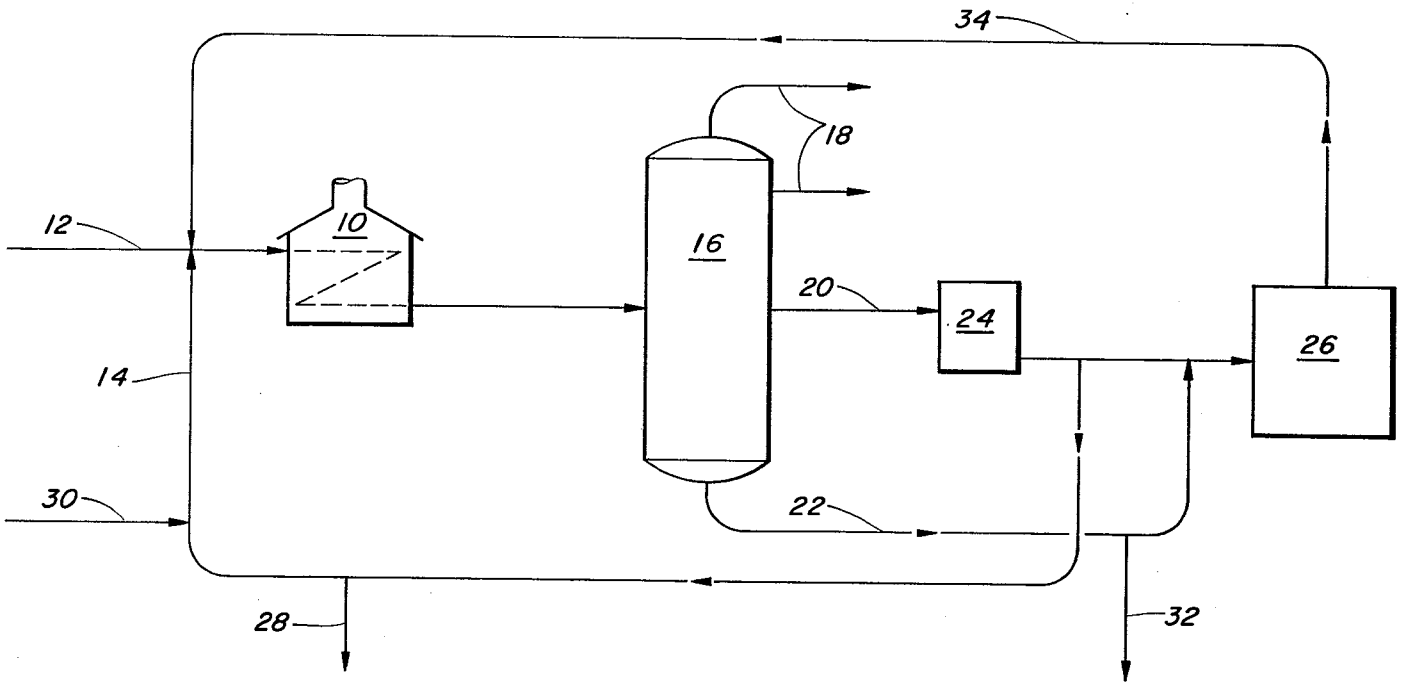
26
32
34
24
18
20
22
16
10
28
12
14
30

HYDROGEN DONOR CRACKING WITH DONOR SOAKING OF PITCH

BACKGROUND OF THE INVENTION

1. Field of the Invention

This invention relates to a process for upgrading residual hydrocarbon oils to more valuable products, and more particularly to a process wherein hydrogen deficient residual petroleum oils are thermally cracked in the presence of a hydrogen donor diluent.

2. Description of the Prior Art

It is known in the art to upgrade hydrogen deficient residual petroleum oils (resid) by thermally cracking the resid in admixture with a hydrogen donor diluent. The hydrogen donor diluent is a material, generally aromatic-napthenic in nature, that has the ability to take up hydrogen under mild hydrogenation conditions and to readily release the hydrogen to a hydrogen deficient resid under thermal cracking conditions. One of the principal advantages of the hydrogen donor diluent cracking (HDDC) process is that it can upgrade resids which are not readily amenable to other conversion processes, and another principal advantage is that it can provide high conversions in the absence of a catalyst and with a minimum of coke deposition. The cracked materials produced by the HDDC process are readily recovered as desirable products including light ends and a gasoline fraction, and the hydrogen donor diluent can be recovered by fractionation of the cracked products and recycled through the hydrogenation step for reuse as donor diluent in the cracking unit.

The HDD process is well known in the art, and a comprehensive description of the process, including materials, flows, and operating conditions, appears in U.S. Pat. No. 2,953,513. Variations of the HDDC process, particularly as to the make-up of the hydrogen donor diluent, are described in U.S. Pat. Nos. 2,873,245 and 3,238,118. Hydrogen donors proposed in the prior art include relatively low boiling, pure, and expensive compounds such as naphthalene, tetralin, decalin, anthracene, and the like. These compounds have generally been considered unsatisfactory for a commercial operation because of their expense and other difficulties inherent in their use. More practical hydrogen donor diluents suggested by prior art include partially hydrogenated catalytic cycle oil, a partially hydrogenated lubricating oil extract or other partially hydrogenated aromatic. Hydrogen donors usually contain condensed ring aromatics in sufficient quantities to serve as a hydrogen carrier. These aromatics are partially hydrogenated; there is added to them some easily removable hydrogen atoms but not enough to convert the aromatics substantially to naphthenes.

U.S. Pat. No. 4,101,416 describes upgrading of tars derived from pyrolysis of coal by hydrogenation, and mentions that hydrogen donor solvents can play a role in this upgrading.

U.S. Pat. No. 4,090,947 describes a hydrogen donor diluent cracking process in which the donor is derived from a premium coking operation.

SUMMARY OF THE INVENTION

According to the present invention, at least part of the pitch fraction from a hydrogen donor diluent cracking operation is heat soaked in the presence of a hydrogen donor solvent for a time and at a temperature sufficient to reduce the amount of heavy asphaltenes in the pitch. The heat soaked pitch is then returned to the cracking coil where additional cracked products are produced from the donor soaked pitch.

It is an object of the present invention to reduce the amount of pitch produced from a hydrogen donor diluent cracking process.

It is a further object to increase the amount of cracked products produced from a hydrogen donor diluent cracking process.

The foregoing as well as additional objects and advantages are provided by this invention, as will be apparent from consideration of the following detailed description of the preferred embodiments thereof.

BRIEF DESCRIPTION OF THE DRAWINGS

The FIGURE is a schematic representation of the improved HDDC process in accordance with the invention.

DESCRIPTION OF THE PREFERRED EMBODIMENTS

The basic hydrogen donor diluent cracking (HDDC) process to which the present invention pertains is thoroughly described in the aforementioned prior art. The present invention is a refinement of the basic process, and provides increased amounts of more valuable cracked products and reduced (or zero) amounts of less valuable pitch. The invention in effect transforms the uncracked (and generally uncrackable) pitch fraction from an HDDC process into crackable components, with a resultant upgraded product distribution compared to a conventional HDDC process.

The FIGURE shows the basic units of an HDDC process, and additionally shows means for accomplishing the objects of the invention.

Fresh feedstock to the HDDC process enters cracking furnace 10 from line 12. Hydrogenated donor solvent from line 14 joins the fresh feed before it enters furnace 10. Cracked products from furnace 10 pass to fractionator 16 where cracked products, spent donor and pitch are recovered through lines 18, 20, and 22 respectively. Spent donor from fractionator 16 is rehydrogenated in hydrotreater 24, and rehydrotreated donor from hydrotreater 24 is returned to furnace 10.

The foregoing general description of the HDDC process conforms to the known art, and various feedstocks, donors, operating conditions, etc., are known in the art.

The essential novel portion of the illustrated process in accordance with the invention involves taking a part of the rehydrogenated donor from line 14 and passing it to a soaking tank 26. At least part of the pitch fraction from fractionator 16 is also passed to soaking tank 26. Any net make of donor is recovered from line 28, and any makeup donor needed is provided through line 30. If less than all of the pitch is to be donor soaked, net pitch is recovered through line 32. In some cases, the pitch can be recycled to extinction, and there will be no net pitch product.

All of the donor soaked pitch from tank 26 preferably is returned to furnace 10 through line 34, although if desired a side stream could be recovered.

The operable ratio of donor to pitch in tank 26 is not exactly determined, but generally will be within the range of 1:5 to 5:1 volumes of donor for each volume of pitch. Preferably, about 0.5 to 2.0 volumes of donor are used for each volume of pitch.

Conditions in the soaking tank can vary considerably, but generally should be at least about 500° F. in order to obtain a useful rate of hydrogen transfer, and generally should be below about 850° F. to avoid significant cracking in the soaking tank. The pressure should be adequate to prevent significant vaporization of the solvent at the temperature being used.

The residence time in soaking tank 26 is inversely proportional to the temperature, and can range from days at 500° F. to minutes at 850° F. Preferably, a temperature of 600°–700° F. and a residence time of 1–3 hours are utilized.

The effectiveness of the process of the invention in upgrading hydrogen donor pitch to crackable material can be demonstrated by comparing the level of pentane, toluene and tetrahydrofuran (THF) insolubles in untreated pitch and in the same pitch after heat soaking in a hydrogen donor solvent. The results of such a comparison are shown below for an actual HDDC pitch material before and after being soaked in an equal volume of hydrogen donor solvent at 675° F. for 2 hours:

| (Weight Percent) | | |
|---|---|---|
| Pentane | Toluene | THF |
| INSOLUBLES BEFORE DONOR SOAKING | | |
| 22 | 1 | 1 |
| INSOLUBLES AFTER DONOR SOAKING | | |
| 8 | nil | nil |

The above illustrates that more than half of asphaltic material in the pitch was converted. More severe conditions could be utilized to increase the conversion, and additional phases such as from repeated soaking after additional cracking would also further reduce the amount of asphaltic material. It is possible to recycle the pitch to extinction in some cases by simply not drawing any pitch product from the fractionator. In most cases, however, some pitch will be removed to prevent a buildup of metals contaminants and to remove intractable components from the system.

The foregoing description of the preferred embodiments of the invention is intended to be illustrative rather than limiting. Variations and modifications will be apparent within the true scope of the invention, which is defined in the appended claims:

We claim:

1. In a hydrogen donor diluent cracking process in which a heavy hydrocarbonaceous material is thermally cracked in a cracking coil in the presence of hydrogen donor solvent, and in which spent donor is separated from cracked products, rehydrogenated and recycled to the cracking step, the improvement wherein at least part of the pitch fraction from the cracked products is heat soaked in a soaking tank separate from said cracking coil in the presence of hydrogenated donor solvent for a time and at a temperature sufficient to substantially reduce the amount of material in said pitch which is insoluble in pentane and said heat-soaked pitch is returned to said cracking coil.

2. The process of claim 1 wherein the entire pitch fraction from said cracked products is heat soaked.

3. The process of claim 1 wherein said part of said pitch fraction is heat soaked at a temperature of from 500° to 850° F.

4. The process of claim 3 wherein said part of said pitch fraction is heat soaked for a period of from 1 to 3 hours at a temperature of from 600 to 700° F.

5. The process of claim 3 wherein said part of said pitch fraction is heat soaked until the amount of pentane insolubles in said pitch fraction is reduced by more than 50 percent.

6. The process of claim 3 wherein said part of said pitch fraction is heat soaked in the presence of from 0.5 to 2.0 volumes of hydrogen donor solvent per volume of pitch treated.

* * * * *